US008960375B2

(12) United States Patent
Katsura

(10) Patent No.: US 8,960,375 B2
(45) Date of Patent: Feb. 24, 2015

(54) ELEVATOR MONITORING AND CONTROL METHOD AND APPARATUS THAT SET AND EXECUTE CONTROL PATTERNS

(75) Inventor: Masaomi Katsura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 646 days.

(21) Appl. No.: 13/259,540

(22) PCT Filed: May 22, 2009

(86) PCT No.: PCT/JP2009/002262

§ 371 (c)(1),
(2), (4) Date: Sep. 27, 2011

(87) PCT Pub. No.: WO2010/134132

PCT Pub. Date: Nov. 25, 2010

(65) Prior Publication Data

US 2012/0055741 A1 Mar. 8, 2012

(51) Int. Cl.

| | |
|---|---|
| ***B66B 1/18*** | (2006.01) |
| ***B66B 3/00*** | (2006.01) |
| ***B66B 1/24*** | (2006.01) |

(52) U.S. Cl.

CPC ..... *B66B 3/00* (2013.01); *B66B 1/2408* (2013.01); *B66B 1/2458* (2013.01); *B66B 2201/403* (2013.01); *B66B 2201/406* (2013.01)

USPC ..... 187/382; 187/295; 187/391; 187/247

(58) Field of Classification Search

USPC ..... 187/247, 277, 289, 293, 295, 296, 297, 187/380–388, 391, 393

See application file for complete search history.

(56) References Cited

U.S. PATENT DOCUMENTS

| | | | | |
|---|---|---|---|---|
| 4,760,896 | A * | 8/1988 | Yamaguchi | 187/382 |
| 4,947,965 | A * | 8/1990 | Kuzunuki et al. | 187/387 |
| 5,010,472 | A * | 4/1991 | Yoneda et al. | 700/49 |

(Continued)

FOREIGN PATENT DOCUMENTS

| | | |
|---|---|---|
| JP | 04 64581 | 2/1992 |
| JP | 04 371468 | 12/1992 |
| JP | 5-201622 A | 8/1993 |
| JP | 11 167413 | 6/1999 |
| JP | 3035143 | 4/2000 |

OTHER PUBLICATIONS

International Search Report issued Jul. 14, 2009 in PCT/JP09/002262 filed May 22, 2009.

(Continued)

*Primary Examiner* — Anthony Salata
(74) *Attorney, Agent, or Firm* — Oblon, Spivak, McClelland, Maier & Neustadt, L.L.P.

(57) ABSTRACT

An elevator monitoring and control method which involves indicating the condition of a plurality of elevators in indicators and controlling the plurality of elevators on the basis of a prescribed input. Since in control setting processing, it is possible to set a plurality of control items as a control pattern, in control execution processing, elevator control by a plurality of control items is made possible simply by executing the control pattern, with the result that it becomes possible to improve operability and to reduce the frequency of wrong operations. Furthermore, control execution processing can be performed after isolating part of the control patterns set in the control setting processing, with the result that it becomes possible to take speedy and flexible steps even in an emergency and to improve operability.

9 Claims, 11 Drawing Sheets

(56) References Cited

U.S. PATENT DOCUMENTS

| | | | | | |
|---|---|---|---|---|---|
| 5,159,163 | A | | 10/1992 | Bahjat et al. | |
| 5,257,176 | A | * | 10/1993 | Uetani | 700/83 |
| 5,307,903 | A | * | 5/1994 | Morita et al. | 187/382 |
| 5,780,789 | A | * | 7/1998 | Tsuji | 187/382 |
| 5,786,550 | A | * | 7/1998 | Thangavelu | 187/386 |
| 5,841,084 | A | * | 11/1998 | Thangavelu | 187/382 |
| 5,892,190 | A | * | 4/1999 | Morita et al. | 187/382 |
| 6,269,911 | B1 | * | 8/2001 | Richter | 187/289 |
| 8,151,943 | B2 | * | 4/2012 | de Groot | 187/382 |

OTHER PUBLICATIONS

Japanese Office Action issued Jun. 4, 2013 in Patent Application No. 2011-514227 with English Translation.

Office Action issued Jan. 15, 2014 in Chinese Patent Application No. 200980159436.2 (with partial English translation).

Chinese Office Action issued Jun. 13, 2014, in China Patent Application No. 200980159436.2 (with Partial English translation).

* cited by examiner

1: Monitoring and control apparatus
2a-2j: Protocol conversion devices
4: Indicator
5a: Elevator controller
5b: Driving control circuit 1: Monitoring and control apparatus
2a-2j: Protocol conversion devices
4: Indicator
21: Indicator control means
22: Control pattern registration means
23: Control pattern storage means
24: Execution control instruction generating means
25: Execution control instruction output means
26: Execution control instruction storage means

ELEVATOR MONITORING AND CONTROL METHOD AND APPARATUS THAT SET AND EXECUTE CONTROL PATTERNS

TECHNICAL FIELD

The present invention relates to an elevator monitoring and control method, a program, and an elevator monitoring and control apparatus for monitoring and controlling the operation condition of a plurality of elevators installed in a building.

BACKGROUND ART

Patent Literature 1 discloses a conventional elevator monitoring and control apparatus for monitoring and controlling the operation condition of a plurality of elevators installed in a building. A conventional elevator monitoring and control apparatus is provided with a central processing unit (CPU), a storage device which stores programs to be executed by the central processing unit (a ROM or RAM), and an indicator provided in a monitoring room where a building manager (a user) resides. And such an elevator monitoring and control apparatus causes the information obtained by monitoring elevators to be indicated on the screen of the indicator, and controls the elevators in response to screen operations of the indicator by the user.

In order to perform the control of the elevators, the elevator monitoring and control apparatus performs the following processing. First of all, the elevator monitoring and control apparatus performs the setting of a plurality of control items in response to the screen operations of the indicator by the user. Each of the control items is intended for controlling one elevator or a plurality of elevators by functions which are different from each other, and for example, one function is "remote-controlled pause," which will be described later. As the setting content of each control item, one elevator or a plurality of elevators to be controlled by the control item are identified. Next, when an instruction for control execution is given by the screen operation of the user for at least one control item among the relevant plurality of set control items, the plurality of elevators identified as each setting content are controlled by each of the control items for which the instruction has been given.

In Patent Literature 1, one control item is composed of a plurality of "modes" and it is ensured that as the setting content of each mode, one elevator or a plurality of elevators which are controlled by the control item are specified. And by the screen operation of the user, first, one control item is selected from the plurality of control items, and next, at least one mode is selected from the plurality of modes constituting the selected control item, whereby an instruction for control execution is given. When the instruction for the control execution is given, the elevator identified as the setting content of each selected relevant mode is controlled by the selected relevant control item. Similarly, instructions for control execution are given also for other control items.

In the case where as described above, elevator control is divided into setting processing and execution processing of control items, whereby in the case where the same elevator is controlled in the next and succeeding elevator control by the same control items as the last time, elevator control is made possible by omitting the setting processing of control items and performing only the execution processing of the control items.

CITATION LIST

Patent Literature

Patent Literature 1: Japanese Patent Laid-Open No. 4-371468 (paragraphs 0107 to 0112, paragraphs 0126 to 0127, FIGS. 8 to 10)

SUMMARY OF INVENTION

Technical Problem

However, in such conventional elevator monitoring and control apparatus as that described above, control items were set independently of each other. As a result of this, when elevator control is to be performed simultaneously by a plurality of control items, users had to give instructions for the execution of control in regard to each control item. Therefore, for a user who repeated the same elevator control many times, it was necessary to perform the same series of actions each time, posing the problem of poor operability and inducement of wrong operations.

Furthermore, in such conventional elevator monitoring and control apparatus as that described above, it was impossible to perform control after a partial change of the setting content of each control item. As a result of this, when control was to be performed by isolating part of elevators, temporarily as in an emergency, from a plurality of elevators identified as the setting content of a certain control item, it was impossible to omit the setting processing of the control items and hence it was necessary to perform both the setting processing and execution processing of the control items. Therefore, it was impossible to deal speedily with emergencies, posing the problem of poor operability.

The present invention was made to solve the above-described problems, and the object of the invention is to provide an elevator monitoring and control apparatus having high functions and good operability.

Solution to Problem

An elevator monitoring and control method of the present invention is a method which involves indicating the condition of a plurality of elevators in indication means and controlling the plurality of elevators on the basis of a prescribed input. The elevator monitoring and control method comprises a control pattern setting step of setting, for each of a plurality of control items, a controlled object, which is controlled by each control item, by a prescribed input and setting the setting content of the plurality of control items as the setting content of one control pattern, a control pattern storage step of storing the setting content of a plurality of control patterns set in the control pattern setting step, and a control execution step of indicating the plurality of control patterns stored in the control pattern storage step in the indication means and executing the control of a plurality of elevators on the basis of the setting content of the plurality of control items constituting one control pattern selected from the plurality of control patterns which are indicated.

A program of the present invention is a program for indicating in indication means the condition of a plurality of elevators and for causing a central processing unit of an elevator monitoring and control apparatus which controls the plurality of elevators on the basis of a prescribed input to execute a control pattern setting step of setting, for each of a plurality of control items, a controlled object, which is controlled by each control item, by a prescribed input and setting the setting content of the plurality of control items as the setting content of one control pattern, a control pattern storage step of storing the setting content of a plurality of control patterns set in the control pattern setting step, and a control execution step of indicating the plurality of control patterns stored in the control pattern storage step in the indication means and executing the control of a plurality of elevators on the basis of the setting content of the plurality of control items constituting one control pattern selected from the plurality of control patterns which are indicated.

An elevator monitoring and control apparatus of the present invention is an apparatus which indicates the condition of a plurality of elevators in indication means and controls the plurality of elevators on the basis of a prescribed input. The elevator monitoring and control apparatus comprises indication means which indicates the condition of the plurality of elevators, program storage means which stores the above-described program, and a central processing unit which executes a program stored in the program storage means.

Advantageous Effects of Invention

According to the present invention, because in control setting processing, it is possible to set a plurality of control items as a control pattern, in control execution processing, elevator control by a plurality of control items is made possible simply by executing the control pattern. As a result of this, it becomes possible to improve operability.

Furthermore, control execution processing can be performed after changing part of the control pattern set in the control setting processing. As a result of this, it becomes possible to take speedy and flexible steps as required, making it possible to improve operability.

DESCRIPTION OF EMBODIMENTS

Figure 1:
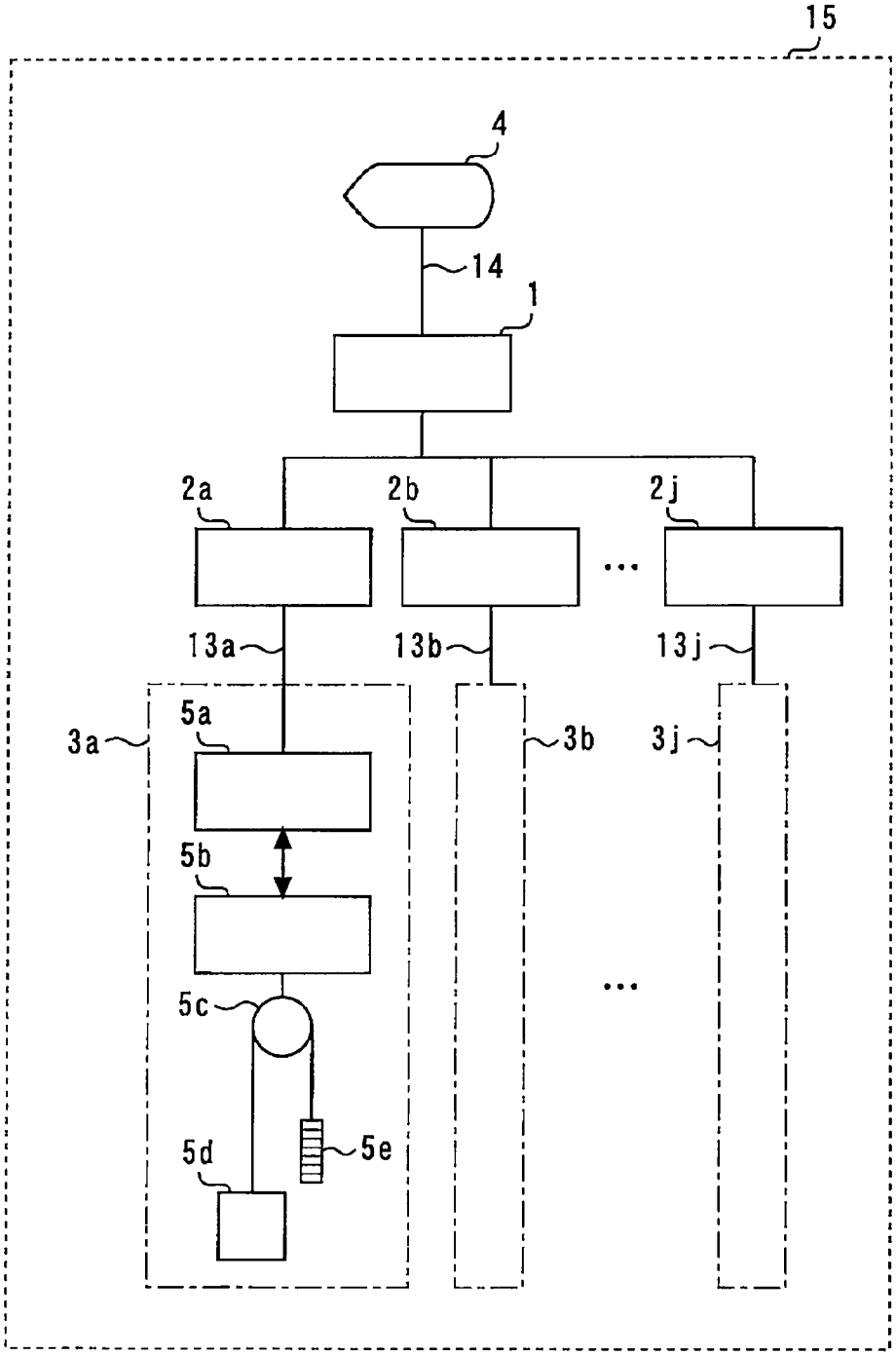
FIG. 1 is a block diagram showing the basic system of an elevator control apparatus of the present invention.

An embodiment of the present invention will be described. FIG. 1 is a block diagram showing the basic system of an elevator control apparatus of the present invention. In this embodiment, one system is built in one building 15. Reference numeral 15 denotes a building, and reference numerals 3*a* to 3*j* denote elevators installed in the building 15, showing that there are ten elevators 3*a* to 3*j* in the building 15. In this embodiment, the elevators 3*a* to 3*c* constitute a first bank, the elevators 3*d* to 3*f* constitute a second bank, the elevators 3*g* and 3*h* constitute a third bank, and the elevators 3*i* and 3*j* constitute a fourth bank. That is, there are four banks in the building 15. "Bank" herein refers to a group of one or a plurality of elevators, for which one and the same operation is performed, and some floors may have different banks even in a group composed of a combination of the same elevator. In contrast to this, "elevator" refers to a single elevator (for each car).

Protocol conversion devices 2*a* to 2*j* are connected to the elevators 3*a* to 3*j* via communication cables 13*a* to 13*j* and connected to a monitoring and control apparatus 1 via a bus 11. The monitoring and control apparatus monitors the operation condition of the elevators 3*a* to 3*j* and controls the elevators 3*a* to 3*j* by control setting processing and control execution processing, which will be described later. The connection mode of the monitoring and control apparatus 1, the protocol conversion devices 2*a* to 2*j* and the elevators 3*a* to 3*j* among them is not limited to this.

The detailed configuration of the elevators 3*a* to 3*j* will be described by taking the elevator 3*a* as an example. An elevator car 5*d* and a weight 5*e* are raised and lowered by a traction machine 5*c*, and the traction machine 5*c* is controlled by a driving control circuit 5*b*. On the basis of an execution control instruction received from the monitoring and control apparatus 1, the elevator controller 5*a* controls the driving control circuit 5*b*. The elevator controller 5*a* and the driving control circuit 5*b* are housed in a control panel (not shown) of the elevator 3*a*. Also the elevators 3*b* to 3*j* have the same configuration. The protocol conversion device 2*a* converts communication protocols between the monitoring and control apparatus 1 and the elevator controller 5*a* of the elevator 3*a*. Also the protocol conversion devices 2*a* to 2*j* perform similar actions.

The monitoring and control apparatus 1 monitors and controls all of the elevators 3*a* to 3*j* installed in the building 15. An indicator 4 which is indication means is connected to the monitoring and control apparatus 1 via a communication cable 14. The indicator 4 and the monitoring control apparatus 1 are installed in a monitoring room where a building manager resides permanently. The manager (user) can perform input operations from a screen indicated on the indicator 4 by using a touch panel (not shown) provided on the screen of the indicator 4, a light pen, keyboard, mouse and the like (not shown) connected to the indicator 4.

Figure 2:
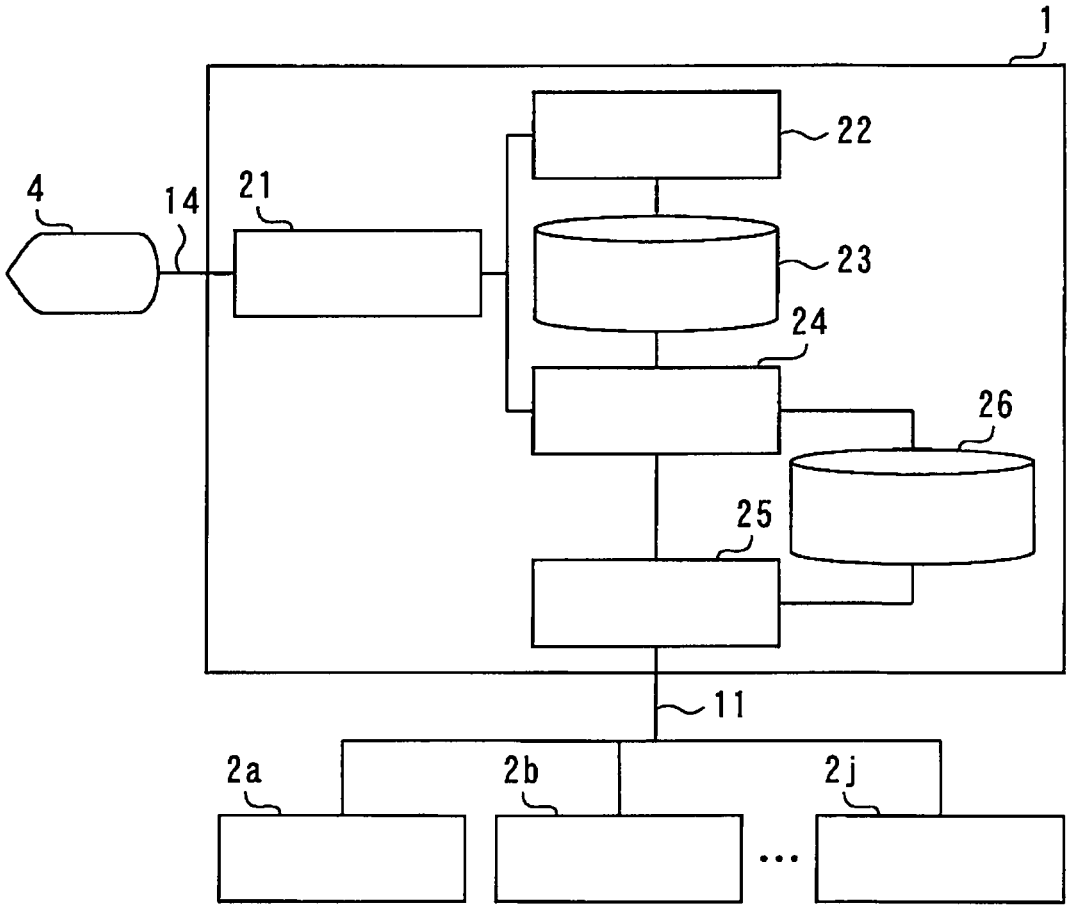
FIG. 2 is an explanatory diagram of the block configuration of a monitoring and control apparatus.

Next, with reference to FIG. 2, the detailed configuration of the monitoring and control apparatus 1 will be described. FIG. 2 is an explanatory diagram of the block configuration of the monitoring and control apparatus 1. The monitoring and control apparatus 1 incorporates a central processing unit (CPU) and a storage devices (ROM and RAM) that is program storage means, which are not shown in the figure, and performs actions as described below because the central processing unit processes a program inputted beforehand to this storage device.

Indicator control means 21 controls the external indicator 4 connected via the communication cable 14. Control pattern registration means 22 registers the setting content of a control pattern which is set by the user by the input operation of a screen indicated on the indicator 4 in control pattern storage means 23. "Control pattern" refers to the content of control for controlling a plurality of elevators installed in the building simultaneously by a plurality of control items. The control pattern storage means 23 can store the setting content of a plurality of control patterns.

Execution control instruction generating means 24 reads in a control pattern registered in the control pattern storage means 23, and generates an execution control instruction on the basis of the read-in control pattern. Furthermore, the execution control instruction generating means 24 registers the generated execution control instruction in execution control instruction storage means 26, and outputs an output instruction to execution control instruction output means 25. On receiving the output instruction from the execution control instruction generating means 24, the execution control instruction output means 25 outputs the execution control instruction registered in the execution control instruction storage means 26 to the elevators 3*a* to 3*j* via the protocol conversion devices 2*a* to 2*j*.

Next, with reference to FIGS. 3 to 10, a description will be given of the control setting processing performed by the monitoring and control apparatus 1 and of the order of screens indicated on the indicator 4 for the duration when this control setting processing is being performed. "Control setting processing" refers to the processing for setting control patters.

Figure 3:
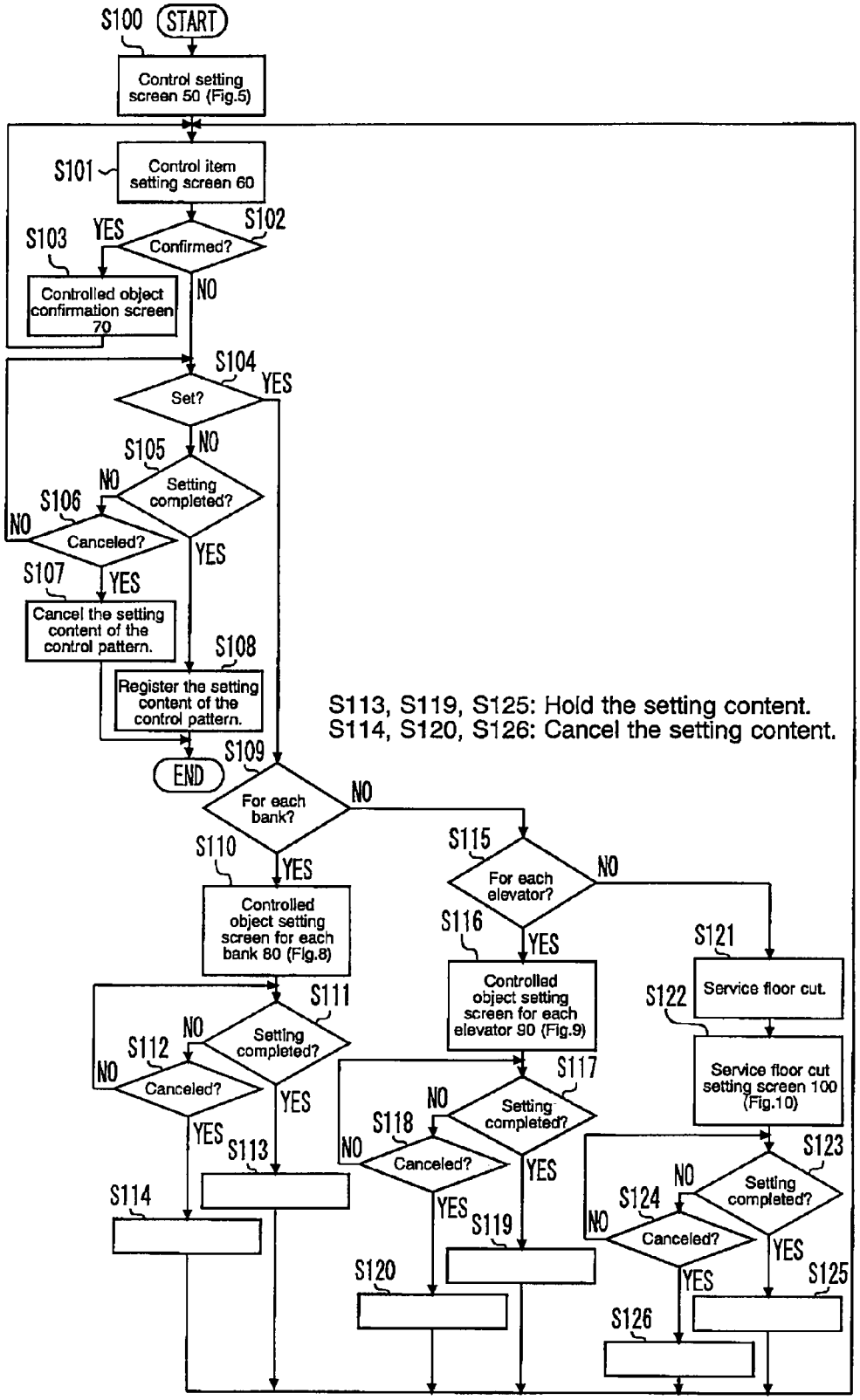
FIG. 3 is a flowchart of control setting processing.
Figure 4:
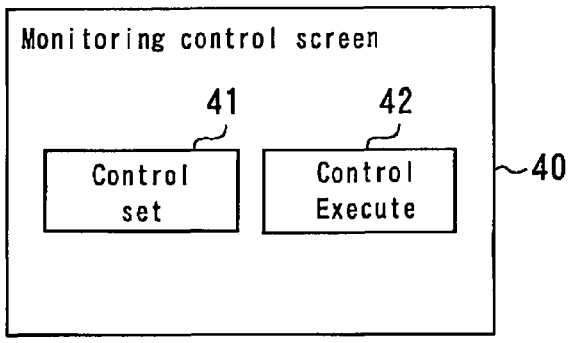
FIG. 4 is a diagram showing a monitoring control screen 40.

Usually, the indicator control means 21 of the monitoring and control apparatus 1 causes the indicator 4 to indicate a monitoring control screen 40 shown in FIG. 4. The information (not shown) obtained by the monitoring and control apparatus 1 by monitoring the elevators 3*a* to 3*j* is indicated on the monitoring control screen 40, and the monitoring control screen 40 has a control setting button 41 for starting control setting processing and a control execution button 42 for starting control execution processing. When the user selects the control setting button 41, the monitoring and control apparatus 1 starts control setting processing in accordance with the flowchart shown in FIG. 3.

Figure 5:
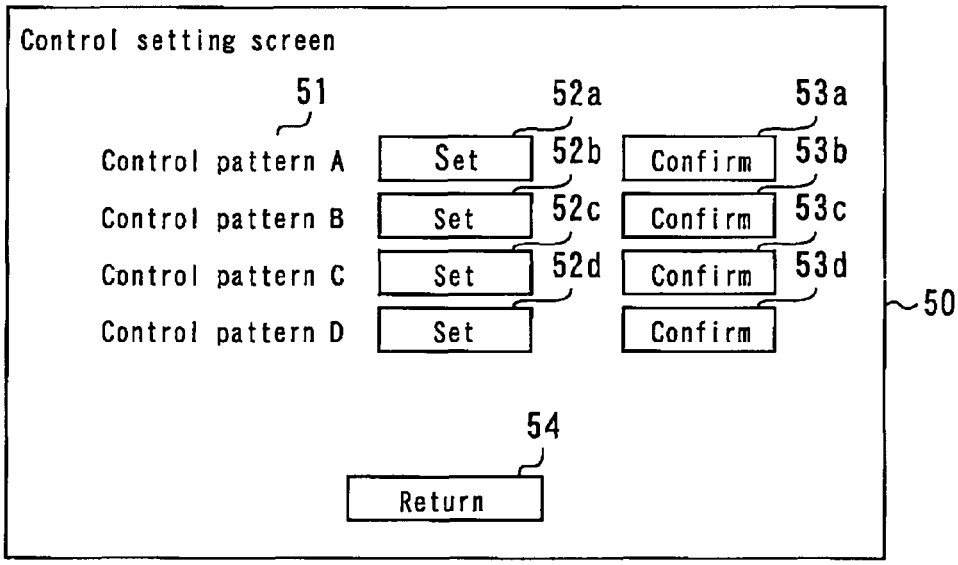
FIG. 5 is a diagram showing a control setting screen 50.

When the control setting button 41 of the monitoring control screen 40 was selected, the indicator control means 21 causes the indicator 4 to indicate a control setting screen 50 shown in FIG. 5 (S100). The control setting screen 50 has a pattern name indication column 51 in which the names of a plurality of control patterns ("control pattern A" to "control pattern D") are indicated, setting buttons 52*a* to 52*d* corresponding to the control patterns indicated in the pattern name indication columns 51 and confirmation buttons 53*a* to 53*d*, and a previous screen indication button 54 for returning to the screen indicated last time.

Though not shown in the flowchart of FIG. 3, the indicator control means 21 makes a judgment as to whether or not the confirmation buttons 53*a* to 53*d* of the control pattern setting screen 50 were selected, whether or not the setting buttons 52*a* to 52*d* were selected, and whether or not the previous screen indication button 54 was selected. And when any one of the confirmation buttons 53*a* to 53*d* was selected, next, the indicator control means 21 causes the indicator 4 to indicate a control pattern confirmation screen (not shown) for confirming the content which has been set at the present moment regarding a control pattern corresponding to the selected confirmation button. For example, when the confirmation button 53*a* of the control setting screen 50 of FIG. 5 was selected in S100, the content set at the present moment regarding "control pattern A" is indicated on the control pattern confirmation screen which is not shown. On the other hand, when the previous screen indication button 54 was selected, the indicator control means 21 again causes the indicator 4 to indicate the monitoring control screen 40. Hereafter, a description will be given of the processing performed by the monitoring and control apparatus 1 when any one of the setting buttons 52*a* to 52*d* was selected.

When any one of the setting buttons 52*a* to 52*d* of the control setting screen 50 was selected in S100, next, the indicator control means 21 causes the indicator 4 to indicate a control item setting screen 60 (S101). The control item setting screen 60 has control item name indication column 61 in which the names of the control items ("up peak service," "down peak service," "remote-controlled pause," and "service floor cut"), setting buttons 62*a* to 62*d* corresponding to the control items indicated in the control item name indication column 61 and confirmation buttons 63*a* to 63*d*, a setting completion button 64, and a cancel button 65. The control items indicated in the control item name indication column 61 constitute a control pattern corresponding to the setting button selected on the control setting screen 50 of FIG. 5 in S100. For example, when the setting button 52*a* of the control setting screen 50 of FIG. 5 was selected in S100, in S101 a plurality of control items constituting "control pattern A" are indicated in the control item name indication column 61 of the control item setting screen 60 of FIG. 6. Incidentally, although the four control items of "up peak service," "down peak service," "remote-controlled pause," and "service floor cut" are indicated in FIG. 6, control items are not limited to these.

Each of the above-described control items will be described here. "Up peak service" and "down peal service" are control items for performing elevator control for each bank. In the former, the timing, number and the like of elevator cars which are called to lower floors are controlled so that the waiting time of passengers on the lower floors who want to move upward does not become long, for example, in the up peak operation in an office building. In the latter, the timing, number and the like of elevator cars which are called to higher floors are controlled so that the waiting time of passengers on the higher floors who want to move downward does not become long, for example, in the down peak operation in an office building. "Remote-controlled pause" is a control item for performing control for each elevator, and an elevator car whose service has been finished is called back to a designated floor and is brought into automatic standstill. "Service floor cut" is a control item for performing control for each elevator hall, and for isolating a designated floor from the object of the services performed by an elevator car. Each "hall" is identified by an elevator and a floor.

Figure 6:
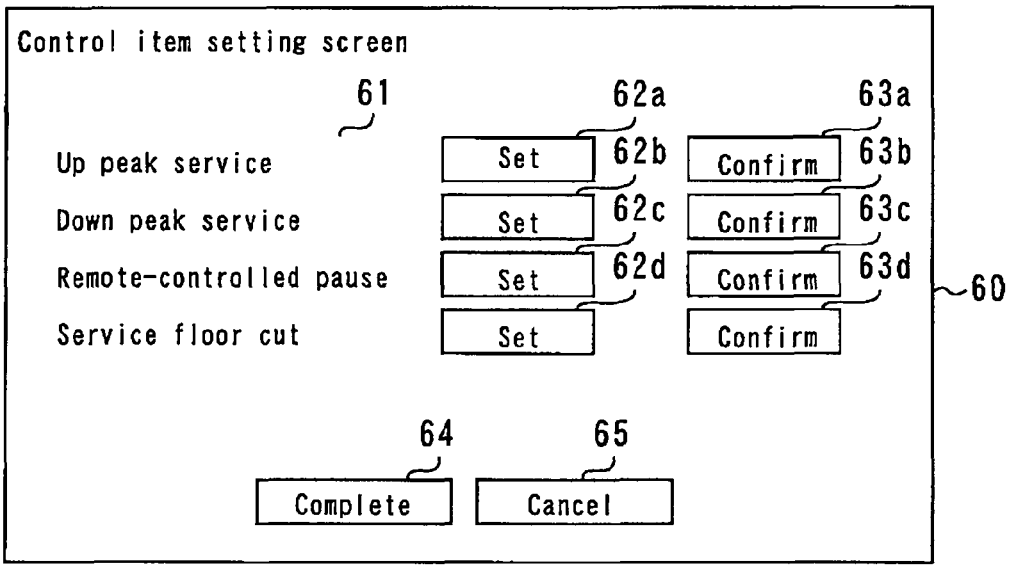
FIG. 6 is a diagram showing a control item setting screen 60.
Figure 7:
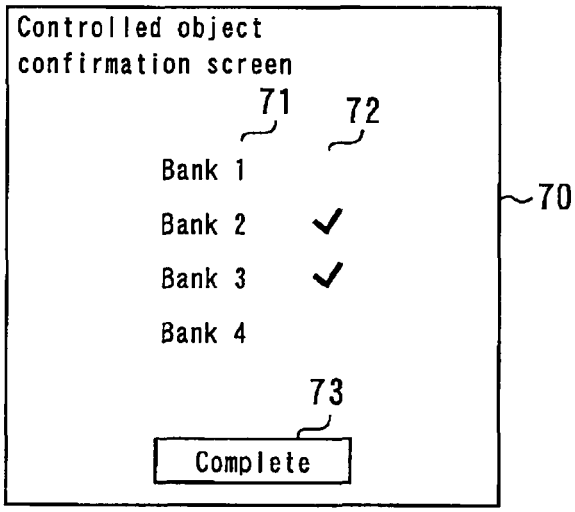
FIG. 7 is a diagram showing a controlled object confirmation screen 70.

The indicator control means 21 makes a judgment as to which of the confirmation buttons 63*a* to 63*d* of the control item setting screen 60 of FIG. 6 was selected (S102). When in S102 any of the confirmation buttons 63*a* to 63*d* was selected, next, the indicator control means 21 causes a controlled object confirmation screen 70 to be indicated (S103). The controlled object confirmation screen 70 has a controlled object name indication column 71 in which the names of controlled objects in the building 15 are indicated for each bank, the elevator or the hall, a check indication column 72, and a confirmation completion button 73. In the check indication column 72, a check mark is indicated so as to correspond to a controlled object name to which a prescribed control item is effectively applied at the present moment. This "prescribed control item" is a control item corresponding to the confirmation button selected in the control item setting screen 60 of FIG. 6 in 5102. This controlled object confirmation screen 70 is such that it is ensured that the indication content thereof is not complied by the user. When the confirmation completion button 73 was selected by the user in S103, the flow of processing returns to S101, where the indicator control means 21 causes the control item setting screen 60 of FIG. 6 to be indicated.

Incidentally, the controlled object indicated in the controlled object name indication column 71 is indicated for each bank when in S102 the control item corresponding to the confirmation button of the control item setting screen 60 is "up peak service" or "down peak service." On the other hand, in the case of "remote-controlled pause," the controlled object is indicated for each elevator, and in the case of the "service floor cut," the controlled object is indicated for each hall.

When any of the confirmation buttons 63*a* to 63*d* was not selected in S102, next, the indicator control means 21 makes a judgment as to whether or not any one of the setting buttons 62*a* to 62*d* was selected (S104). When any one of the setting buttons 62*a* to 62*d* was selected in S104, next, the indicator control means 21 makes a judgment as to whether or not the control item corresponding to the selected setting button is a control item for which control is performed for each bank ("up peak service" or "down peak service") (S109).

Figure 8:
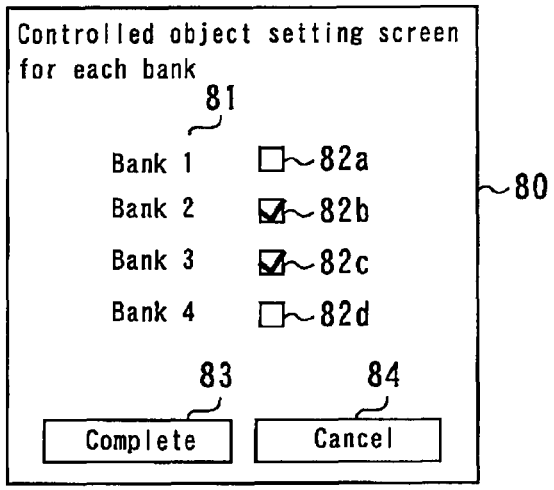
FIG. 8 is a diagram showing a controlled object setting screen for each bank 80.

When it was judged in S109 that the control item in question is a control item for which control is performed for each bank, next, the indicator control means 21 causes the indicator 4 to indicate a controlled object setting screen for each bank 80 (S110). The controlled object setting screen for each bank 80 has a bank name indication column 81 in which the names of controlled objects in the building 15 are indicated for each bank, check boxes 82*a* to 82*d* corresponding to the bank names indicated in the bank name indication column 81, a setting completion button 83, and a cancel button 84. The check boxes 82*a* to 82*d* are such that the indication or non-indication of a check is selected by the user. And "up peak service" or "down peak service" is effectively applied to a bank corresponding to a check box in which a check is indicated. FIG. 8 shows that "up peak service" or "down peak service" is effectively applied to "bank 2" and "bank 3."

The indicator control means 21 makes a judgment as to whether or not the setting completion button 83 of the controlled object setting screen for each bank 80 of FIG. 8 was selected (S111). When the setting completion button 83 was selected in S111, next, the indicator control means 21 holds the content set on the controlled object setting screen for each bank 80 (S113) and the flow of processing returns to S101, where the indicator control means 21 causes the control item setting screen 60 of FIG. 6 to be indicated. When the setting completion button 83 was not selected in S111, next, the indicator control means 21 makes a judgment as to whether or not the cancel button 84 was selected (S112). When the cancel button 84 was selected in S112, next, the indicator control means 21 cancels the previous setting content (S114), and the flow of processing returns to S101, where the indicator control means 21 causes the control item setting screen 60 of FIG. 6 to be indicated. When the cancel button 84 was not selected in S112, the flow of processing returns to S111, where the indicator control means 21 makes a judgment as to whether or not the setting completion button 83 of the controlled object setting screen for each bank 80 of FIG. 8 was selected.

On the other hand, when the indicator control means 21 judged in S109 that the control item in question is not a control item for which control is performed for each bank, next, the indicator control means 21 makes a judgment as to whether or not the control item corresponding to the setting button selected in S104 on the control item setting screen 60 of FIG. 6 is a control item for which control is performed for each elevator ("remote-controlled pause") (S115). When the indicator control means 21 judged in S115 that the control item in question is a control item for which control is performed for each elevator, next, the indicator control means 21 causes the indicator 4 to indicate a controlled object setting screen for each elevator 90 shown in FIG. 9 (S116). The controlled object setting screen for each elevator 90 has an all-bank, all-elevator button 91, a bank name indication column 92 in which the names of controlled objects in the building 15 are indicated for each bank, an all-elevator button 93 corresponding to each bank indicated in the bank name indication column 92, an elevator name indication column 94 in which the name of each of the elevators constituting each bank indicated in the bank name indication column 92 is displayed, a check box 95 corresponding to each elevator indicated in the elevator name indication column 94, a setting completion button 96, and a cancel button 97.

Figure 9:
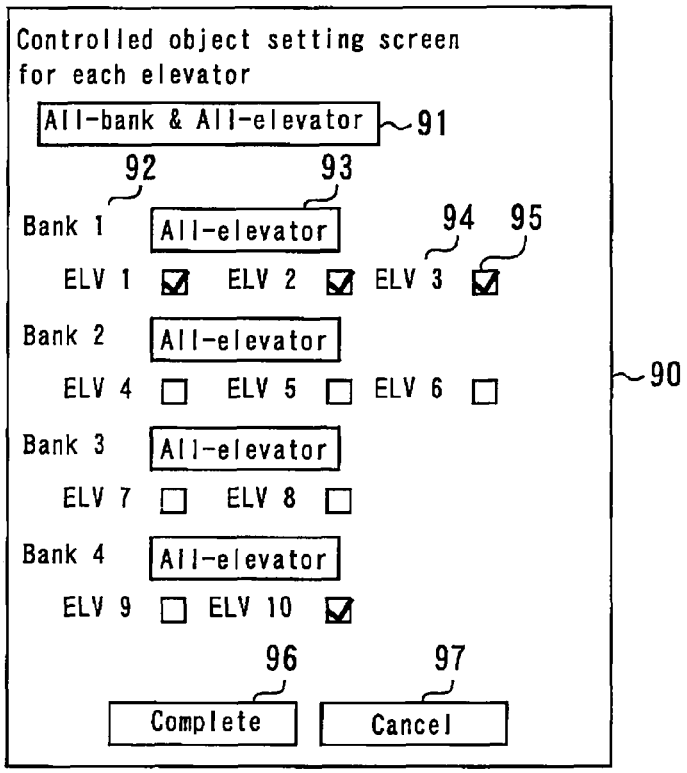
FIG. 9 is a diagram showing a controlled object setting screen for each elevator 90.

The check box 95 is such that the user makes a selection between the indication and non-indication of a check. And "remote-controlled pause" is effectively applied to an elevator corresponding to a check box in which a check has been indicated. In order to ensure that the user can perform easy operations, the all-bank, all-elevator button 91 and the all-elevator button 93 are provided. When the all-bank, all-elevator button 91 has been selected, a check is indicated/non-indicated in all of the check boxes 95. When the all-elevator button 93 has been selected, a check is indicated/non-indicated in all of the check boxes 95 corresponding to all elevators constituting a corresponding bank. FIG. 9 shows that "remote-controlled pause" is effectively applied to "bank 1" and "bank 10."

The indicator control means 21 make a judgment as to whether or not the setting completion button 96 of the controlled object setting screen for each elevator of FIG. 9 was selected (S117). When the setting completion button 96 was selected in S117, next, the indicator control means 21 holds the content set on the controlled object setting screen for each elevator 90 (S119), and the flow of processing returns to S101, where the indicator control means 21 causes the control item setting screen 60 of FIG. 6 to be indicated. When the setting completion button 96 was not selected in S117, next, the indicator control means 21 makes a judgment as to whether or not the cancel button 97 was selected (S118). When the cancel button 97 was selected in S118, next, the indicator control means 21 cancels the previous setting content (S120), and the flow of processing returns to S101, where the indicator control means 21 causes the control item setting screen 60 of FIG. 6 to be indicated. When the cancel button 97 has not been selected in S118, the flow of processing returns to S117, where the indicator control means 21 makes a judgment as to whether or not the setting completion button 96 of the controlled object setting screen for each elevator of FIG. 9 was selected.

Figure 10:
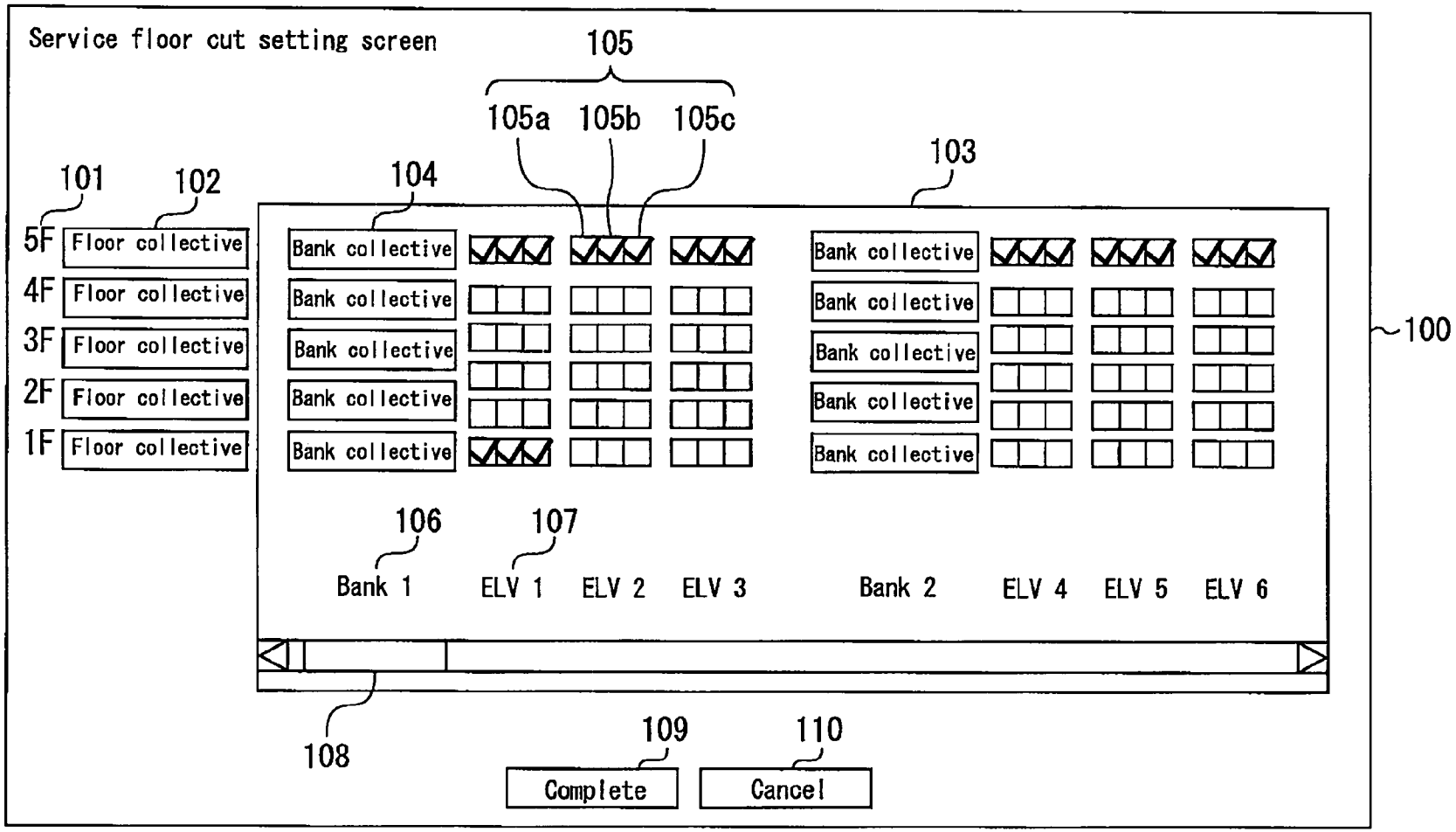
FIG. 10 is a diagram showing a service floor cut setting screen 100.

On the other hand, when the indicator control means 21 judged in S115 that the control item in question was not a control item for which control was performed for each elevator, next, the indicator control means 21 judges that the control item corresponding to the setting button selected in S104 on the control item setting screen 60 of FIG. 6 is "service floor cut" (S121), then causes the indicator 4 to indicate a service floor cut setting screen 100 shown in FIG. 10 (S122). The service floor cut setting screen 100 has a floor name indication column 101 in which the names of floors of the building 15 are indicated, a floor collective button 102 corresponding to each floor indicated in the floor name indication column 101, a scroll window 103, a setting completion button 109, and a cancel button 110. Furthermore, the scroll window 103 has a bank name indication column 106 in which the names of controlled objects in the building 15 are indicated for each bank, an elevator name indication column 107 in which the names of elevators constituting each bank indicated in the bank name indication column 106 are indicated, a check box 105 composed of check boxes 105*a* to 105*c* corresponding to each hall, a bank collective button 104 corresponding to each floor of each bank indicated in the bank name indication column 106, and a scroll bar 108.

The check box 105 is such that the user makes a selection between the indication and non-indication of a check. And "service floor cut" is effectively applied to the floor (hall) of an elevator corresponding to a check box 105 in which a check has been indicated. That is, the floor is isolated from the object of the service performed by that elevator. The "services performed by each elevator" are the three kinds of "upward from-hall call," "downward from-hall call" and "car call." "Upward from-hall call" refers to a service which is such that when a passenger presses an upward button provided in a certain hall, an elevator car which runs upward is called to that floor. "Downward from-hall call" refers to a service which is such that when a passenger presses a downward button provided in a certain hall, an elevator car which runs downward is called to that floor. "Car call" refers to a service which is such that when a passenger designates a certain floor by use of a floor designation button provided in an elevator car, the elevator car is called to the designated floor.

The check boxes 105*a* to 105*c* correspond to "upward from-hall call," "downward from-hall call" and "car call," respectively. FIG. 10 shows that "1st floor" of "elevator 1," "5th floor" of "bank 1," and "5th floor" of "bank 2" are isolated from the objects of "upward from-hall call," "downward from-hall call" and "car call." In order to ensure that the user can perform easy operations, the floor collective button 102 and the bank collective button 104 are provided. When the floor collective button 102 has been selected, a check is indicated/non-indicated in all check boxes 105 on the corresponding floor. When the bank collective button 104 has been selected, a check is indicated/non-indicated in all check boxes 105 on the floor of the corresponding bank.

The indicator control means 21 makes a judgment as to whether or not the setting completion button 109 of the service floor cut setting screen 100 of FIG. 10 was selected (S123). When the setting completion button 109 was selected in S123, next, the indicator control means 21 holds the content set on the service floor cut setting screen 100 (S125), and the flow of processing returns to S101, where the indicator control means 21 causes the control item setting screen 60 of FIG. 6 to be indicated. When the setting completion button 109 was not selected in S123, next, the indicator control means 21 makes a judgment as to whether or not the cancel button 110 was selected (S124). When the cancel button 110 was selected in S124, next, the indicator control means 21 cancels the previous setting content (S126), and the flow of processing returns to S101, where the indicator control means 21 causes the control item setting screen 60 of FIG. 6 to be indicated. When the cancel button 110 was not selected in S124, and the flow of processing returns to S123, where the indicator control means 21 makes a judgment as to whether or not the setting completion button 109 of the service floor cut setting screen 100 of FIG. 10 was selected.

When any of the setting buttons 62*a* to 62*d* of the control item setting screen 60 of FIG. 6 was not selected in S104, next, the indicator control means 21 makes a judgment as to whether or not the setting completion button 64 was selected (S105). When the setting completion button 64 was selected in S105, next, the control pattern registration means 22 registers the setting content of the control pattern corresponding to the setting button selected in S100 on the control pattern setting screen 50 in the control pattern storage means 23 (S108). When the setting button 52*a* of the control setting screen 50 of FIG. 5 is selected in S100, the setting content of "control pattern A" is registered in the control pattern storage means 23 in S108. After S108, the control setting processing of the monitoring and control apparatus 1 is finished and, next, the indicator control means 21 causes the indicator 4 to indicate the monitoring control screen 40 of FIG. 4. The "setting content of control pattern" refers to the setting content of each control item which is held by the indicator control means 21 in S113, S119 or S125. When the processing of S100 to S103 is performed again after S108, the setting content of the control pattern registered in S108 is indicated on the controlled object confirmation screen indicated in S103.

When the setting completion button 64 of the control item setting screen 60 of FIG. 6 was not selected in S105, next, the indicator control means 21 makes a judgment as to whether or not the cancel button 65 was selected (S106). When the cancel button 65 was selected in S106, the previous setting content is canceled (S107). After S107, the control setting processing of the monitoring and control apparatus 1 is finished, and next, the indicator control means 21 causes the indicator 4 to indicate the monitoring control screen 40 of FIG. 4. When the cancel button 65 was not selected in S106, the flow of processing returns to S104, where the indicator control means 21 makes a judgment as to whether or not any one of the setting buttons 62*a* to 62*d* of the control item setting screen 60 of FIG. 6 was selected.

Next, with reference to FIGS. 11 to 18, a description will be given of the control execution processing performed by the monitoring and control apparatus 1 and the order of screens indicated in the indicator 4 while this control execution processing is being performed. "Control execution processing" refers to the processing of executing a control pattern set in control setting processing.

Figure 11:
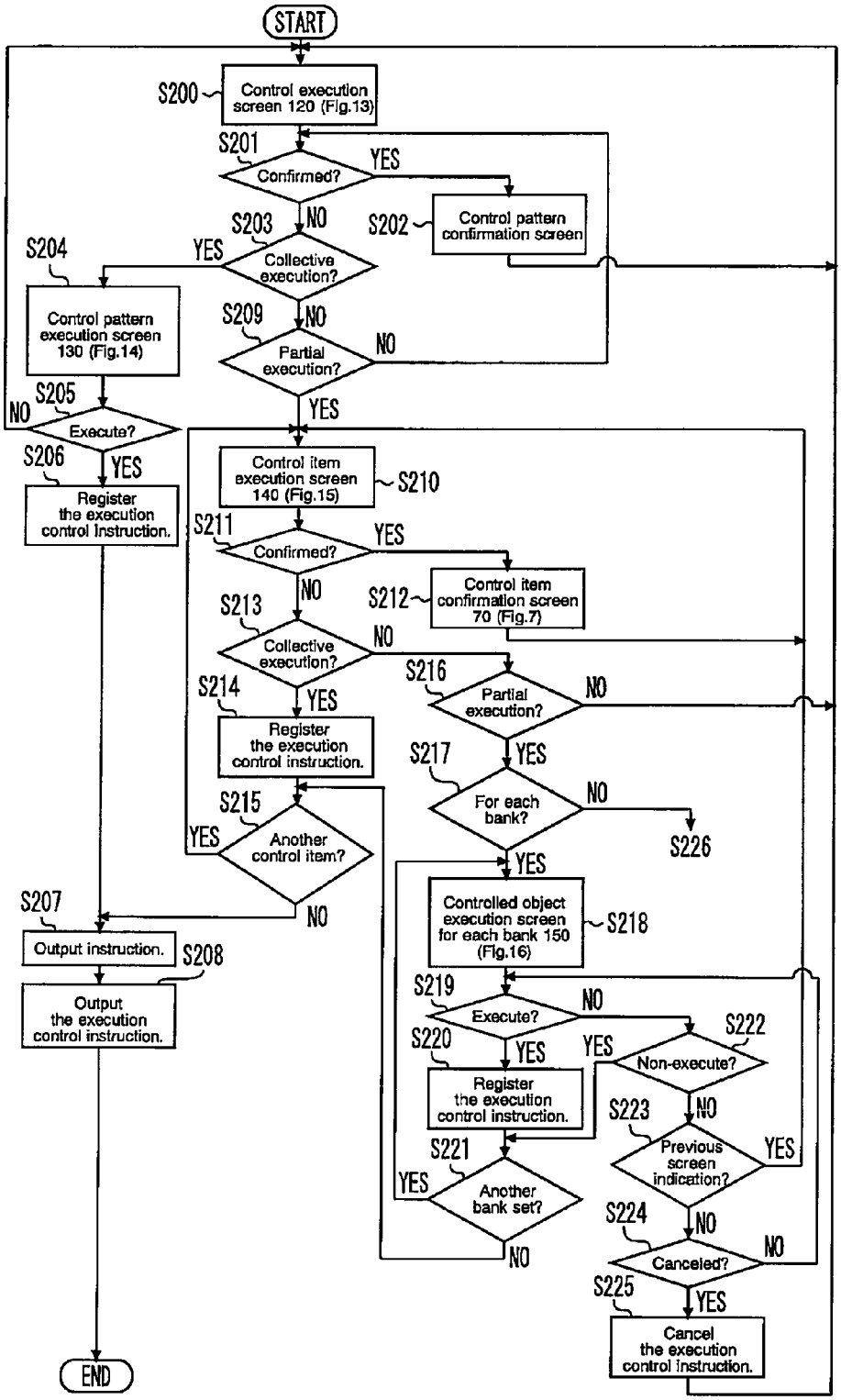
FIG. 11 is a flowchart of S200 to S225 of control execution processing.
Figure 12:
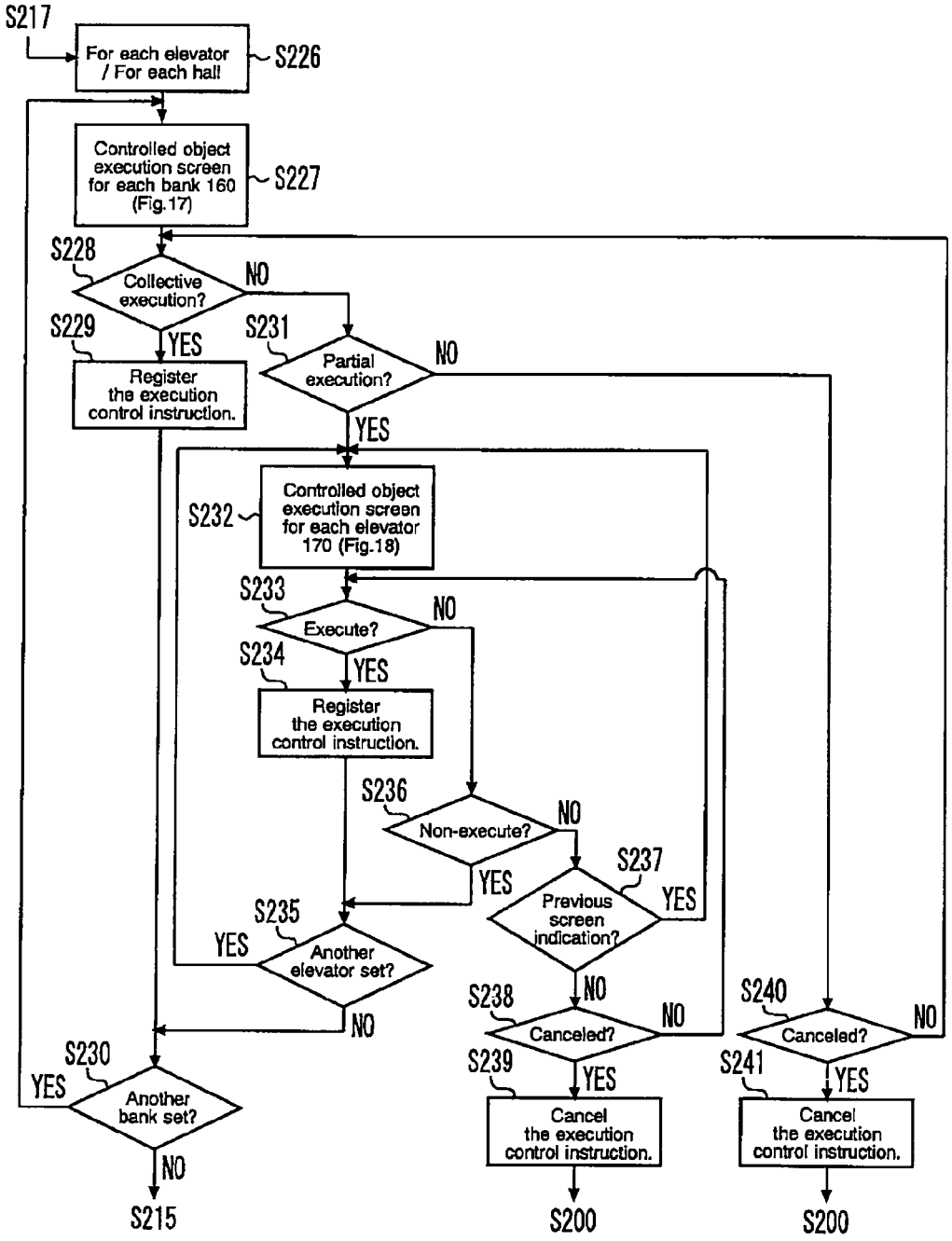
FIG. 12 is a flowchart of S226 to S241 of control execution processing.

When the user has selected the control execution button 42 on the monitoring control screen 40 of FIG. 4, the monitoring and control apparatus 1 starts the processing shown in FIGS. 11 and 12. FIG. 11 is a flowchart of S200 to S225 of control execution processing performed by the monitoring and control apparatus 1. FIG. 12 is a flowchart of S226 to S241 of control execution processing performed by the monitoring and control apparatus 1.

Figure 13:
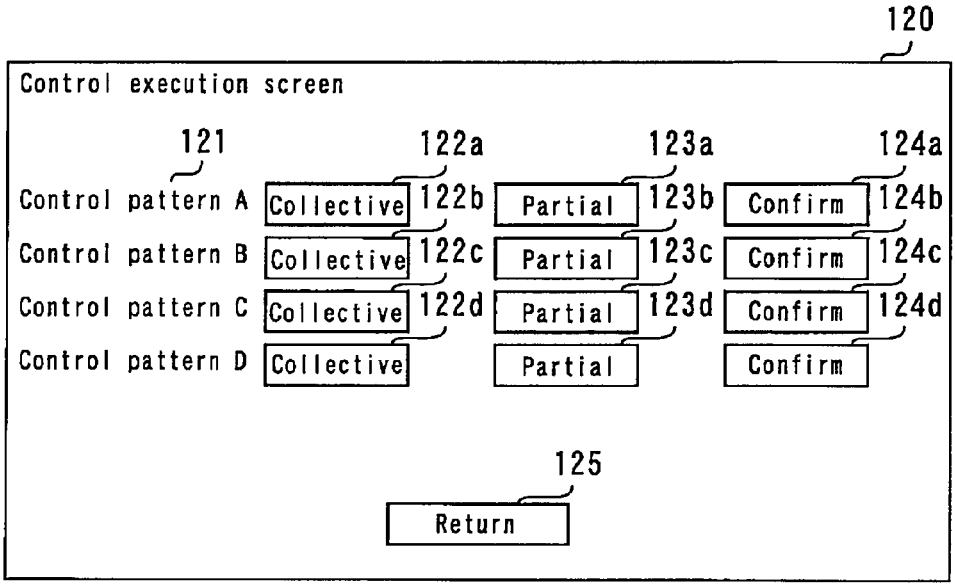
FIG. 13 is a diagram showing a control execution screen 120.

When the control execution button 42 of the monitoring control screen 40 was selected, the monitoring control means 21 causes the indicator 4 to indicate a control execution screen 120 shown in FIG. 13 (S200). The control execution screen 120 has a pattern name indication column 121 where the names of a plurality of control patterns ("control pattern A" to "control pattern D") are indicated, collective execution buttons 122*a* to 122*d* corresponding to the control patterns indicated in the pattern name indication column 121, partial execution buttons 123*a* to 123*d*, confirmation buttons 124*a* to 124*d*, and a previous screen indication button 125. When the previous screen indication button 125 was selected, the indicator control means 21 causes the indicator 4 to indicate the monitoring control screen 40 of FIG. 4.

The indicator control means 21 makes a judgment as to whether or not any one of the confirmation buttons 124*a* to 124*d* of the control pattern execution screen 120 of FIG. 13 is selected (S210). And when any one of the confirmation buttons 124*a* to 124*d* was selected in S201, next, the indicator control means 21 causes a control pattern confirmation screen for indicating the setting content of a control pattern corresponding to the selected confirmation button, which is not shown, to be indicated (S202). For example, when the confirmation button 124*a* of the control pattern execution screen 120 of FIG. 13 is selected in S201, the setting content of "control pattern A" is indicated on the control pattern confirmation screen, which is not shown, in S202. The setting content of the control pattern indicated on this control pattern confirmation screen is the setting content of the control pattern registered in the control pattern storage means 23 in S108 in the control setting processing of FIG. 3. And when the confirmation completion button provided on the control pattern confirmation screen is selected by the user in S202, the flow of processing returns to S200, where the control execution screen 120 of FIG. 13 is caused to be indicated.

When any of the confirmation buttons 124*a* to 124*d* was not selected in S200, next, the indicator control means 21 makes a judgment as to whether or not any one of the collective execution button 122*a* to 122*d* was selected (S203). When any one of the collective execution button 122*a* to 122*d* was selected in S203, next, the indicator control means 21 causes a control pattern execution screen 130 shown in FIG. 14 to be indicated (S204). The control pattern execution screen 130 has a message column 131 in which messages to users are indicated, an execution button 132, and a previous screen indication button 133. Messages indicated in the message column 131 are intended for confirming to users whether or not a prescribed control pattern is executed. A control pattern corresponding to the collective execution button selected in S203 on the control execution screen 120 of FIG. 13 is selected as this "prescribed control pattern." For example, when the collective execution button 122*a* of the control pattern execution screen 120 of FIG. 13 was selected in S203, a message for confirming whether or not "control pattern A" is executed is indicated in S204 on the control pattern execution screen 130 of FIG. 14.

Figure 14:
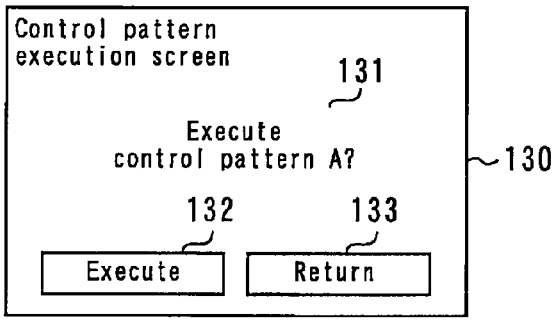
FIG. 14 is a diagram showing a control pattern execution screen 130.

The indicator control means 21 makes a judgment as to whether or not the execution button 132 of the control pattern execution screen 130 of FIG. 14 was selected (S205). And when the execution button 132 was selected in S205, next, the execution control instruction generating means 24 reads in, from the control pattern storage means 23, the setting content of the control pattern indicated in a message of the control pattern execution screen 130. Furthermore, on the basis of the setting content of the read-in control pattern, the execution control instruction generating means 24 generates an execution control instruction and registers the generated execution control instruction in the execution control instruction storage means 26 (S206). The "execution control instruction" is composed of a control signal which controls the elevator controller of each elevator (for example, the elevator controller 5*a* of FIG. 1).

The execution control instruction generating means 24 outputs an output instruction to the execution control instruction output means 25 (S207). This "output instruction" is intended for instructing the execution control instruction output means 25 that the execution control instruction output means 25 outputs the execution control instruction registered in the execution control instruction storage means 26 in S206 by the execution control instruction generating means 24 to the elevator controllers of the plurality of elevators 3*a* to 3*j* in the building 15. After S207, the execution control instruction output means 25 reads in the execution control instruction from the execution control instruction storage means 26 according to the output instruction, and outputs the read-in execution control instruction to the elevator controllers of the elevators 3*a* to 3*j* (S208). After S208, the control execution processing of the monitoring and control apparatus 1 is finished, and next, the indicator control means 21 causes the indicator 4 to indicate the monitoring control screen 40 of FIG. 4.

In the case where the execution button 132 was not selected in S205, next, when the previous screen indication button 133 is selected by the user, the flow of processing returns to S200, where the indicator control means 21 causes the indicator 4 to indicate the control execution screen 120 of FIG. 13.

When any of the collective execution buttons 122*a* to 122*d* of the control execution screen 120 of FIG. 13 was not selected in S203, next, the indicator control means 21 makes a judgment as to whether or not any one of the partial execution buttons 123*a* to 123*d* was selected (S209). When any one of the partial execution buttons 123*a* to 123*d* was selected in S209, next, the indicator control means 21 causes the indicator 4 to indicate a control item execution screen 140 shown in FIG. 15 (S210). The control item execution screen 140 has a message column 141 in which messages to users are indicated, a collective execution button 142, a partial execution button 143, a confirmation button 144, and a previous screen indication button 145. Messages indicated in the message column 141 are intended for confirming to users whether or not a prescribed control item is executed. Any one of a plurality of control items constituting a control pattern corresponding to the partial execution button selected in S209 on the control execution screen 120 of FIG. 13 is selected as this "prescribed control item." For example, when the partial execution button 123*a* of the control pattern execution screen 120 of FIG. 13 was selected in S201, a message for confirming whether or not execution is performed for any one of the plurality of control items constituting "control pattern A" is indicated in S210 on the control item execution screen 140 of FIG. 15.

Figure 15:
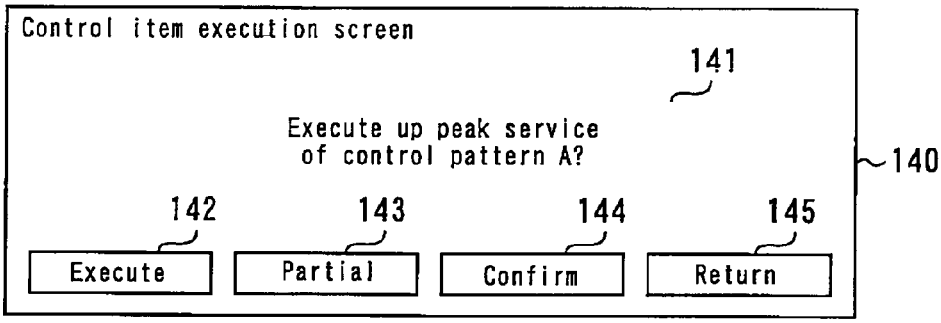
FIG. 15 is a diagram showing a control item execution screen 140.

The indicator control means 21 makes a judgment as to whether or not the confirmation button 144 of the control item execution screen 140 of FIG. 15 was selected (S211). And when the confirmation button 144 was selected in S211, next, regarding the setting content of the control item indicated in the message of the control item execution screen 140, the indicator control means 21 causes the above-described control item confirmation screen 70 to be indicated (S212). The setting content registered in the control pattern storage means 23 in the control setting processing of FIG. 3 in S108 is indicated on this control item confirmation screen 70. And when the confirmation completion button 73 provided on the control item confirmation screen 70 was selected by the user in S212, the flow of processing returns to S210, where the indicator control means 21 causes the control item execution screen 140 of FIG. 15 to be indicated.

When the confirmation button 144 was not selected in S211, next, the indicator control means 21 makes a judgment as to whether or not the collective execution button 142 was selected (S213). When the collective execution button 142 was selected in S213, next, the execution control instruction generating means 24 reads in, from the control pattern storage means 23, the setting content of the control item indicated in the message of the control item execution screen 140 of FIG. 15. Furthermore, the execution control instruction generating means 24 generates an execution control instruction on the basis of the read-in setting content of the control item, and registers the generated execution control instruction in the execution control instruction storage means 26 (S214).

After S214, next, the indicator control means 21 makes a judgment as to whether or not there exists another control item whose setting content has been held in the control setting processing of FIG. 3 among a plurality of control items constituting the control pattern corresponding to the partial execution button selected in S209 on the control execution screen 120 of FIG. 13 (S215). When the indicator control means 21 judged in S215 that such a control item existed, the flow of processing returns to S210, where the indicator control means 21 causes the control item execution screen 140 of FIG. 15 to be indicated. However, in S210, the control item indicated in the message of this control item execution screen 140 is a control item other than the control item indicated in the message of the control item execution screen 140, which was indicated last time, and is selected from any one of the control items set in the control setting processing of FIG. 3 as this control item. When the indicator control means 21 judged in S215 that such a control item did not exist, the flow of processing returns to S207, where the execution control instruction generating means 24 outputs an output instruction to the execution control instruction output means 25.

When the collective execution button 142 of the control item execution screen 140 of FIG. 15 was not selected in S213, next, the indicator control means 21 makes a judgment as to whether or not the partial execution button 143 was selected (S216). When the partial execution button 143 was selected in S216, next, the indicator control means 21 makes a judgment as to whether or not the control item indicated in the message of the control item execution screen 140 is a control item for which control is performed for each bank ("up peak service" or "down peak service") (S217). When the indicator control means 21 judged in S217 that the control item in question is a control item for which control is performed for each bank, next, the indicator control means 21 causes the indicator 4 to indicate a controlled object execution screen for each bank 150 shown in FIG. 16 (S218). The controlled object execution screen for each bank 150 has a message column 151 in which messages to users are indicated, an execution button 152, a non-execution button 153, a previous screen indication button 154, and a cancel button 155. Messages indicated in the message column 151 are intended for confirming to users whether or not a control item indicated in the message of the control item execution screen 140 of FIG. 15 is executed in a prescribed bank. As this "prescribed bank," any one of the banks set in the control setting processing of FIG. 3 is selected as the controlled object of the control item indicated in the message of the control item execution screen 140.

Figure 16:
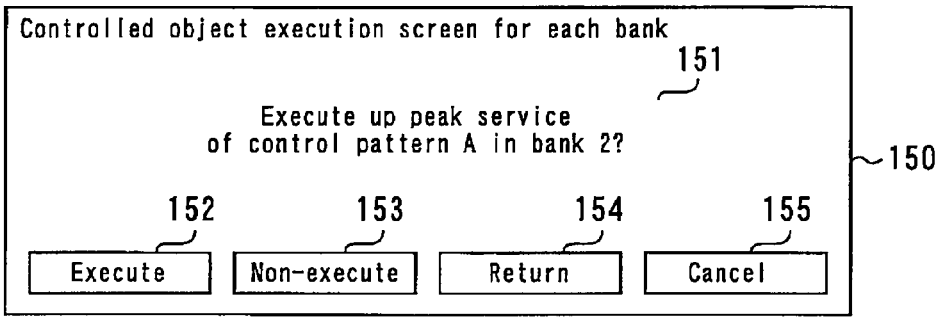
FIG. 16 is a diagram showing a controlled object execution screen for each bank 150.

The indicator control means 21 makes a judgment as to whether or not the execution button 152 of the controlled object execution screen for each bank 150 of FIG. 16 was selected (S219). And when the execution button 152 was selected in S219, next, the execution control instruction generating means 24 reads in, from the control pattern storage means 23, the setting content of a bank indicated in the message of the controlled object execution screen for each bank 150. Furthermore, the execution control instruction generating means 24 generates an execution control instruction on the basis of the read-in setting content of the bank, and registers the generated execution control instruction in the execution control instruction storage means 26 (S220).

After S220, next, the indicator control means 21 makes a judgment as to whether or not there exists another bank set in the control setting processing of FIG. 3 as a controlled object of the control item indicated in the message of the control item execution screen 140 of FIG. 15 (S221). When the indicator control means 21 judged in S221 that such a bank exists, the flow of processing returns to S218, where the indicator control means 21 causes the controlled object execution screen for each bank 150 of FIG. 16 to be indicated. However, in S218, the bank indicated in the message of the controlled object execution screen for each bank 150 is a bank other than the bank indicated in the message of the controlled object execution screen for each bank 150, which was indicated last time, and is selected from any one of the banks set in the control setting processing of FIG. 3 as this bank. When the indicator control means 21 judged in S221 that such a bank did not exist, the flow of processing returns to S215, where the indicator control means 21 makes a judgment as to whether or not there exists another control item whose setting content was held in the control setting processing of FIG. 3.

When the execution button 152 of the controlled object execution screen for each bank 150 of FIG. 16 was not selected in S219, next, the indicator control means 21 makes a judgment as to whether or not the non-execution button 153 was selected (S222). When the non-execution button 153 was selected in S222, the flow of processing returns to S221, where the indicator control means 21 makes a judgment as to whether or not there exists another bank set in the control setting processing of FIG. 3. When the non-execution button 153 was not selected in S222, next, the indicator control means 21 makes a judgment as to whether or not the previous screen indication button 154 was selected (S223). When the previous screen indication button 154 was selected in S223, the flow of processing returns to S210, where the indicator control means 21 causes the control item execution screen 140 of FIG. 15 to be indicated. When the previous screen indication button 154 was not selected in S223, next, the indicator control means 21 makes a judgment as to whether or not the cancel button 155 was selected (S224). When the cancel button 155 was selected in S224, next, the execution control instruction generating means 24 the execution control instruction storage means 26 cancels execution control instructions stored until that time (S225), and the flow of processing returns to S200, where the indicator control means 21 causes the control execution screen 120 of FIG. 13 to be indicated. When the cancel button 155 was not selected in S224, the flow of processing returns to S219, where the indicator control means 21 makes a judgment as to whether or not the execution button 152 of the controlled object execution screen for each bank 150 of FIG. 16 was selected.

When the indicator control means 21 judged in S217 that the control item indicated in the message of the control item execution screen 140 of FIG. 15 was not a control item for which control is performed for each bank, next, the indicator control means 21 that the control item in question is a control item for which control is performed for each elevator ("remote-controlled pause") or a control item for which control is performed for each hall ("service floor cut") (S226). After S226, next, the indicator control means 21 causes the indicator 4 to indicate a controlled object execution screen for each bank 160 shown in FIG. 17(S227). The controlled object execution screen for each bank 160 has a message column 161 in which messages to users are indicated, a collective execution button 162, a partial execution button 163, a non-execution button 164, a previous screen indication button 165, and a cancel button 165. Messages indicated in the message column 161 are intended for confirming to users whether or not a control item indicated in the message of the control item execution screen 140 of FIG. 15 is executed in a prescribed bank. As this "prescribed bank," any one of the banks set in the control setting processing of FIG. 3 is selected as the controlled object of the control item indicated in the message of the control item execution screen 140.

Figure 17:
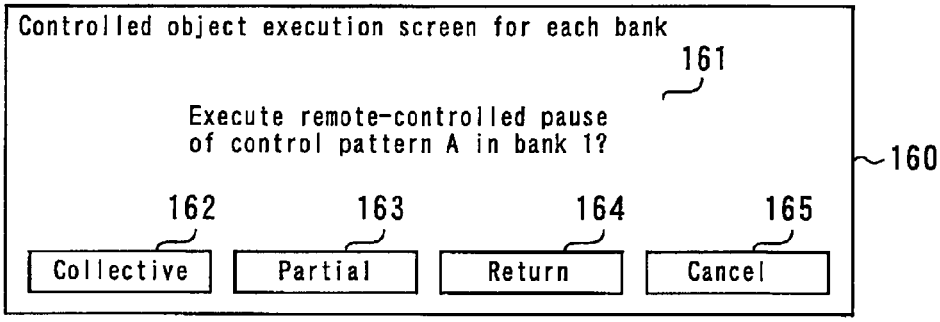
FIG. 17 is a diagram showing a controlled object execution screen for each bank 160.

The indicator control means 21 makes a judgment as to whether or not the collective execution button 162 of the controlled object execution screen for each bank 160 of FIG. 17 was selected (S228). And when the collective execution button 162 was selected in S228, next, the execution control instruction generating means 24 reads in, from the control pattern storage means 23, the setting content of a bank indicated in the message of the controlled object execution screen for each bank 160. Furthermore, the execution control instruction generating means 24 generates an execution control instruction on the basis of the read-in setting content of the bank, and registers the generated execution control instruction in the execution control instruction storage means 26 (S229).

After S229, next, the indicator control means 21 makes a judgment as to whether or not there exists another bank set in the control setting processing of FIG. 3 as a controlled object of the control item indicated in the message of the control item execution screen 140 of FIG. 15 (S230). When the indicator control means 21 judged in S230 that such a bank existed, the flow of processing returns to S227, where the indicator control means 21 causes the controlled object execution screen for each bank 160 of FIG. 17 to be indicated. However, in S227, the bank indicated in the message of the controlled object execution screen for each bank 160 is a bank other than the bank indicated in the message of the controlled object execution screen for each bank 160, which was indicated last time, and is selected from any one of the banks set in the control setting processing of FIG. 3 as this bank. When the indicator control means 21 judged in S230 that such a bank did not exist, the flow of processing returns to S215, where the indicator control means 21 makes a judgment as to whether or not there exists another control item whose setting content was held in the control setting processing of FIG. 3.

When the collective execution button 162 of the controlled object execution screen for each bank 160 of FIG. 17 was not selected in S228, next, the indicator control means 21 makes a judgment as to whether or not the partial execution button 163 was selected (S231). When the partial execution button 163 was selected in S231, next, the indicator control means 21 causes the indicator 4 to indicate a controlled object execution screen for each elevator 170 shown in FIG. 18. The controlled object execution screen for each elevator 170 has a message column 171 in which messages to users are indicated, an execution button 172, a non-execution button 173, a previous screen indication button 174, and a cancel button 175. Messages indicated in the message column 171 are intended for confirming to users whether or not a control item indicated in the message of the control item execution screen 140 of FIG. 15 is executed in a prescribed elevator. As this "prescribed elevator," any one of the elevators set in the control setting processing of FIG. 3 is selected from a plurality of elevators constituting the bank indicated in the message of the controlled object execution screen for each bank 160.

Figure 18:
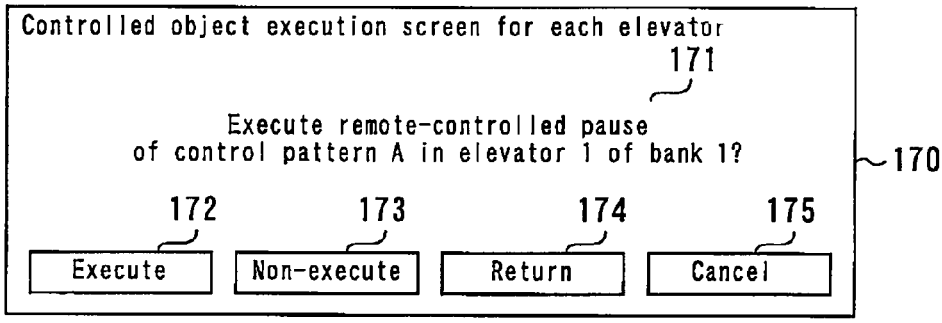
FIG. 18 is a diagram showing a controlled object execution screen for each elevator 170.

The indicator control means 21 makes a judgment as to whether or not the execution button 172 of the controlled object execution screen for each elevator 170 of FIG. 18 was selected (S233). And when the execution button 172 was selected in S233, next, the execution control instruction generating means 24 reads in, from the control pattern storage means 23, the setting content of an elevator indicated in the message of the controlled object execution screen for each elevator 170. Furthermore, the execution control instruction generating means 24 generates an execution control instruction on the basis of the read-in setting content of the elevator, and registers the generated execution control instruction in the execution control instruction storage means 26 (S234).

After S234, the indicator control means 21 makes a judgment as to whether or not there exists another elevator set in the control setting processing among a plurality of elevators constituting the bank indicated in the message of the controlled object execution screen for each bank 160 (S235). When the indicator control means 21 judged in S235 that such an elevator existed, the flow of processing returns to S232, where the indicator control means 21 causes the controlled object execution screen for each elevator 170 of FIG. 18 to be indicated. However, in S232, the elevator indicated in the message of this controlled object execution screen for each elevator 170 is among a plurality of elevators constituting the bank indicated in the message of the controlled object execution screen for each bank 160, and this elevator is an elevator other than the elevators indicated in the message of the controlled object execution screen for each elevator 170, which was indicated last time, and is selected from any one of the elevators set in the control setting processing of FIG. 3. When the indicator control means 21 judged in S235 that such an elevator did not exist, the flow of processing returns to S230, where the indicator control means 21 makes a judgment as to whether or not there exists another bank set in the control setting processing of FIG. 3.

When the execution button 172 of the controlled object execution screen for each elevator 170 of FIG. 18 was not selected in S233, next, the indicator control means 21 makes a judgment as to whether or not the non-execution button 173 was selected (S236). When the non-execution button 173 was selected in S236, the flow of processing returns to S235, where the indicator control means 21 makes a judgment as to whether or not there exists another elevator set in the control setting processing of FIG. 3.

When the non-execution button 173 was not selected in S236, next, the indicator control means 21 makes a judgment as to whether or not the previous screen indication button 174 was selected (S237). When the previous screen indication button 174 was selected in S237, the flow of processing returns to S232, where the indicator control means 21 causes the controlled object execution screen 170 for each elevator 170 shown in FIG. 18 to be indicated. When the previous screen indication button 174 was not selected in S237, next, the indicator control means 21 makes a judgment as to whether or not the cancel button 175 was selected (S238). When the cancel button 175 was selected in S238, next, the execution control instruction storage means 26 cancels execution control instructions which have been stored until that time (S239), the flow processing returns to S200, where the indicator control means 21 causes the control execution screen 120 shown in FIG. 13 to be indicated. When the cancel button 175 was not selected in S238, the flow processing returns to S233, where the indicator control means 21 makes a judgment as to whether or not the execution button 172 of the controlled object execution screen for each elevator 170 of FIG. 18 was selected.

When the partial execution button 163 of the controlled object execution screen for each bank 160 of FIG. 17 was not selected in S231, next, the indicator control means 21 makes a judgment as to whether or not the cancel button 165 was selected (S240). When the cancel button 165 was selected in S240, next, the execution control instruction storage means 26 cancels execution control instructions which have been stored until that time (S241), and the flow of processing returns to S200, where the indicator control means 21 causes the control execution screen 120 shown in FIG. 13 to be indicated. When the cancel button 165 was not selected in S240, the flow of processing returns to S228, where the indicator control means 21 makes a judgment as to whether or not the collective execution button 162 of the controlled object execution screen for each bank 160 of FIG. 17 was selected.

S100 to S107 and S109 to S126 correspond to the control pattern setting step, S108 corresponds to the control pattern storage step, and S200 to S241 correspond to the control execution step. And in S200 to S241, S208 and S209 correspond to the control pattern judgment step, S204 to S206 correspond to the control pattern execution step, and S210 to S241 correspond to the control item execution step. Furthermore, S213 and S216 correspond to the control item judgment step, S214 corresponds to the control item collective-execution step, and S217 to S241 correspond to the control item partial-execution step.

The order and content of indication of each drawing indicated in the indicator 4 can be appropriately changed so long as such changes can solve the problems of the present invention.

According to this embodiment, it is possible to set a plurality of control items collectively as one control pattern in control setting processing, and hence in performing control execution processing, elevator control by a plurality of control items is made possible simply by executing one control pattern. As a result of this, for example, in the case where two different control patterns, control pattern A and control pattern B, are to be alternately executed, simply by setting control pattern A and control pattern B in the control setting processing, control pattern A or control pattern B can be alternately selected and executed in the succeeding control execution processing. Therefore, it is possible to improve operability and reduce the frequency of wrong operations.

Furthermore, control execution processing can be performed after isolating part of control pattern set in control setting processing. As a result of this, for example, in the case where elevator 1 is to be isolated from controlled objects for one hour during the execution of control pattern A, control pattern A is executed after isolating elevator 1 from the controlled objects of control pattern A in control execution processing. And when control execution processing is to be performed again in one hour, control pattern A is executed without changing the controlled objects. Therefore, it becomes possible to take speedy and flexible steps even in an emergency, making it possible to improve operability.

REFERENCE SIGNS LIST

1 monitoring and control apparatus
3*a*-3*j* elevators
4 indicator
5*a* elevator controller
5*b* driving control circuit
5*c* traction machine
5*d* car
5*e* weight
21 indicator control means
22 control pattern registration means
23 control pattern storage means
24 execution control instruction generating means
25 execution control instruction output means
26 execution control instruction storage means

The invention claimed is:

1. An elevator monitoring and control method to indicate a condition of a plurality of elevators in an indicator and control the plurality of elevators on the basis of a prescribed input, the elevator monitoring and control method comprising:

setting, for each of a plurality of control items, a controlled object that is controlled by respective control items, by a prescribed input;

setting respective setting content of the plurality of control items as setting content of one control pattern;

storing respective setting content of a plurality of control patterns; and indicating the plurality of control patterns from the storing, in the indicator;

indicating in the indicator whether setting content of a plurality of control items constituting a selected control pattern that is selected from the plurality of control patterns is collectively executed or partially executed;

generating an execution control instruction based on the setting content of the selected control pattern when the setting content of the selected control pattern is selected to be collectively executed;

indicating whether or not setting content of a selected control item is executed for each control item constituting the selected control pattern and generating the execution control instruction based on setting content of each control item selected for execution when the setting content of the selected control pattern is selected to be partially executed; and executing control of a plurality of elevators according to the setting content of the selected control pattern and the execution control instruction.

2. The elevator monitoring and control method according to claim 1, further comprising:

indicating in the indicator whether the setting content of the selected control item is to be collectively executed or partially executed for each of the control items constituting the selected control pattern when the setting content of the selected control pattern is selected to be partially executed;

generating the execution control instruction based on the setting content of the selected control item when the selected control item is selected to be collectively executed; and changing the setting content of the selected control item when the selected control item is selected to be partially executed and generating the execution control instruction based on changed setting content.

3. The elevator monitoring and control method according to claim 2, wherein for the respective setting content of each of the plurality of control items, a respective controlled object is set by the prescribed input by being identified for each bank of the plurality of elevators, for each elevator, or for each hall, and wherein generating the execution control instruction based on the changed setting content includes generating an instruction so that respective controlled objects of control items selected to be partially executed are isolated for each bank of the plurality of elevators, for each elevator, or for each hall, and remaining controlled objects are controlled by the control items selected.

4. A non-transitory computer-readable medium storing instructions, which when executed by a central processing unit of an elevator monitoring and control apparatus which controls a plurality of elevators and includes an indicator, cause the central processing unit to perform the method comprising:

setting, for each of a plurality of control items, a controlled object that is controlled by respective control items, by a prescribed input;

setting respective setting content of the plurality of control items as setting content of one control pattern;

storing respective setting content of a plurality of control patterns;

indicating the plurality of control patterns stored from the storing, in the indicator;

indicating in the indicator whether setting content of a plurality of control items constituting a selected control pattern that is selected from the plurality of control patterns is collectively executed or partially executed;

generating an execution control instruction based on the setting content of the selected control pattern when the setting content of the selected control pattern is selected to be collectively executed;

indicating whether or not setting content of a selected control item is executed for each control item constituting the selected control pattern and generating the execution control instruction based on setting content of each control item selected for execution when the setting content of the selected control pattern is selected to be partially executed; and executing control of a plurality of elevators according to the setting content of the selected control pattern and the execution control instruction.

5. The non-transitory computer-readable medium according to claim 4, wherein the method performed by the central processing unit further comprises:

indicating in the indicator whether the setting content of the control item is to be collectively executed or partially executed for each of the control items constituting the selected control pattern when the setting content of the selected control pattern is selected to be partially executed;

generating the execution control instruction based on the setting content of the selected control item when the selected control item is selected to be collectively executed; and changing the setting content of the selected control item when the selected control item is selected to be partially executed and generating the execution control instruction based on changed setting content.

6. The non-transitory computer-readable medium according to claim 5, wherein for the respective setting content of each of the plurality of control items, a respective controlled object is set by the prescribed input by being identified for each bank of the plurality of elevators, for each elevator, or for each hall, and wherein generating the execution control instruction based on the changed setting content includes generating an instruction so that respective controlled objects of control items selected to be partially executed are isolated for each bank of the plurality of elevators, for each elevator, or for each hall, and remaining controlled objects are controlled by the control items selected.

7. An elevator monitoring and control apparatus which indicates a condition of a plurality of elevators in an indicator and controls the plurality of elevators on the basis of a prescribed input, comprising:

the indicator that indicates the condition of the plurality of elevators;

a non-transitory computer-readable medium according to of claim 4; and a central processing unit which executes instructions stored on the non-transitory computer-readable medium.

8. An elevator monitoring and control apparatus which indicates the condition of a plurality of elevators and controls the plurality of elevators on the basis of a prescribed input, comprising:

an indicator that indicates the condition of the plurality of elevators;

a non-transitory computer readable medium according to claim 5; and a central processing unit which executes instructions stored on the non-transitory computer readable medium.

9. An elevator monitoring and control method to indicate a condition of a plurality of elevators in an indicator and control the plurality of elevators on the basis of a prescribed input, the elevator monitoring and control method comprising:

setting, for each of a plurality of control items, a controlled object that is controlled by respective control items, by a prescribed input;

setting respective setting content of the plurality of control items as setting content of one control pattern;

storing respective setting content of a plurality of control patterns;

indicating the plurality of control patterns from the storing, in the indicator;

indicating in the indicator whether setting content of a plurality of control items constituting a selected control pattern that is selected from the plurality of control patterns is collectively executed or partially executed;

generating an execution control instruction based on a selection between executing the selected control pattern collectively and partially;

executing control of a plurality of elevators according to the setting content of the selected control pattern and the execution control instruction.

* * * * *